United States Patent [19]

Johnston et al.

[11] 4,199,062

[45] Apr. 22, 1980

[54] LIQUID CONTAINER WITH HANG FLAP

[75] Inventors: William D. Johnston, Buffalo Grove, Ill.; Richard J. Von Drasek, Alliston, Canada; Warren J. Bull, III, Marion, N.C.

[73] Assignee: Baxter Travenol Laboratories, Inc., Deerfield, Ill.

[21] Appl. No.: 35,847

[22] Filed: May 4, 1979

Related U.S. Application Data

[63] Continuation of Ser. No. 896,029, Apr. 13, 1978, abandoned.

[51] Int. Cl.[2] ..... B65D 85/54

[52] U.S. Cl. ..... 206/525; 150/1; 206/806

[58] Field of Search ..... 150/1, 8; 206/525, 806; 128/214 D, DIG. 24; D24/58

[56] References Cited

U.S. PATENT DOCUMENTS

| | | | |
|---|---|---|---|
| D. 201,940 | 8/1965 | Bellamy | D24/58 |
| 3,331,421 | 7/1967 | Lambert | 150/9 |
| 3,519,158 | 7/1970 | Anderson | 150/1 X |
| 3,661,153 | 5/1972 | Polk | 150/8 UX |
| 3,777,697 | 12/1973 | Woessner | 116/227 |
| 3,828,779 | 8/1974 | Ogle | 128/272 |
| 3,915,212 | 10/1975 | Bujan | 150/8 |

*Primary Examiner*—Donald F. Norton
*Attorney, Agent, or Firm*—Paul C. Flattery; John P. Kirby, Jr.; Eugene M. Cummings

[57] ABSTRACT

A single-dose liquid container for storage in a sterile condition within an overpouch includes a hang flap portion which is folded over within the overpouch to minimize storage requirements. To prevent adhesion between the hang flap portion and the underlying container body portion upon subsequent autoclaving of the combined container and overpouch the hang flap is formed with a depressed field portion within which a plurality of raised rib-like spacer portions are provided to minimize the contact area between the hang flap and the body section.

12 Claims, 9 Drawing Figures

LIQUID CONTAINER WITH HANG FLAP

This is a continuation of application Ser. No. 896,029, filed Apr. 13, 1978 and now abandoned.

BACKGROUND OF THE INVENTION

In recent years a wide variety of parental and urological solutions have become available pre-packaged in sterile non-pyrogenic single-dose liquid containers for intravenous and urological administration. Typically, such single-dose containers, of which the 50 milliliter to 1 liter "Viaflex" and 1 liter to 3 liter "Uromatic" containers marketed by Baxter Travenol Laboratories, Inc. are examples, have been in the form of flexible bags formed from two sheets of polyvinylchloride or similar biologically compatible material heat-sealed along the margins of a central body section thereof to form a liquid chamber of the desired volume. A port section, consisting of one or more ports, is typically provided at one end of the central portion for connection with a separately packaged administration set or irrigation means, and a tab-like hang flap section having an aperture for hanging the container in an elevated position with respect to a patient is typically provided at the other end. One or more depressed rib portions, formed by heat seals between the flap sections of the two sheets, were typically included in the container construction.

To maintain single-dose liquid containers sterile, the containers are typically packaged in an overpouch, which, like the containers, may be formed from two sheets of flexible non-pyrogenic material heat sealed along their margins. The overpouch and container combination are subjected to autoclaving wherein they are heated to a temperature sufficient to insure complete sterilization.

To minimize the volume required for storage, it is desirable that the container and overpouch combination be as compact as possible for a given volume of solution. To this end, it has become conventional to fold the port and end flap sections over the central body section of the container, thereby reducing the overall length of the container and the required length of the overpouch. While this arrangement has proven generally satisfactory, it has been found that on occasions the surface of the folded flap section tended to adhere to the underlying exterior surface of the body section during the autoclaving process, with the result that upon subsequent opening of the overpouch and peeling back of the hang flap section the container was unsuitable for use. The depressed rib portions provided on the hanger flap section were only slightly effective in reducing this tendency for adhesion.

One solution to the adhesion problem was the provision of a polyethylene separator sheet between the adjacent surfaces of the hang flap and body sections of the container. Unfortunately, placement of this sheet during packaging of the container within the overpouch complicated the manufacturing process, thereby increasing the cost of manufacture as well as the material cost of the container. The present invention is directed to an improved construction for the liquid container which minimizes the tendency for such adhesion with minimal increase in the manufacturing cost of the container.

Accordingly, it is a general object of the present invention to provide a new and improved container for parental and urological solutions.

It is a more specific object of the present invention to provide a new and improved container for parental and urological solutions which can be compactly packaged in an overpouch and autoclaved without adhesion of the hang flap section to the body section thereof.

SUMMARY OF THE INVENTION

The present invention is directed to a container for parental and urological solutions and the like formed from two sheets of flexible non-pyrogenic material sealed about the margin of a central body section thereof to form a liquid chamber. A port section including one or more ports is provided at one end of the body section for establishing fluid communication with the chamber, and a hang flap section is provided at the opposite end of the body section for suspending the container from an external support member. In accordance with the invention, the hang flap section is formed by extensions of the two sheets which form the container. The extensions are bonded together to form a depressed field portion within which a plurality of raised rib portions are provided to minimize the contact area between the flap section and the body section when the flap section is folded over for storage.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
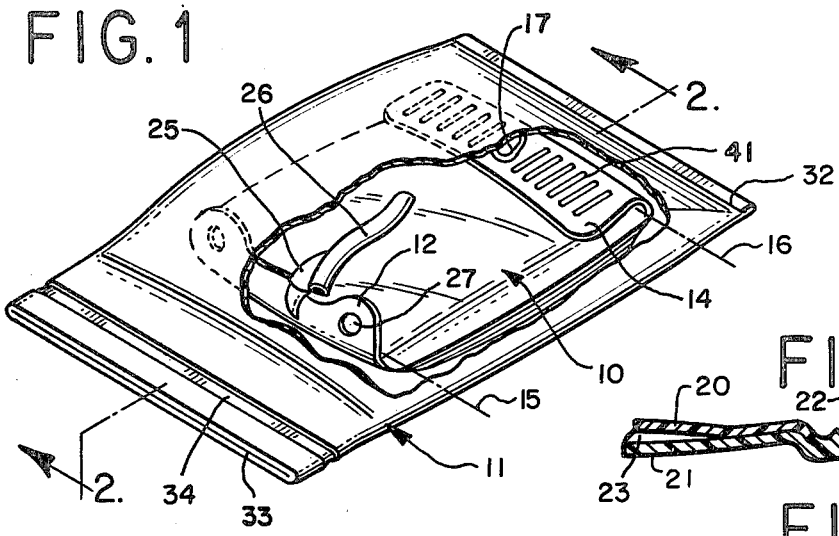
FIG. 1 is a perspective view of a single-use liquid container constructed in accordance with the invention sealed within an overpouch partially broken away to show the placement of the container within the overpouch.
Figure 2:
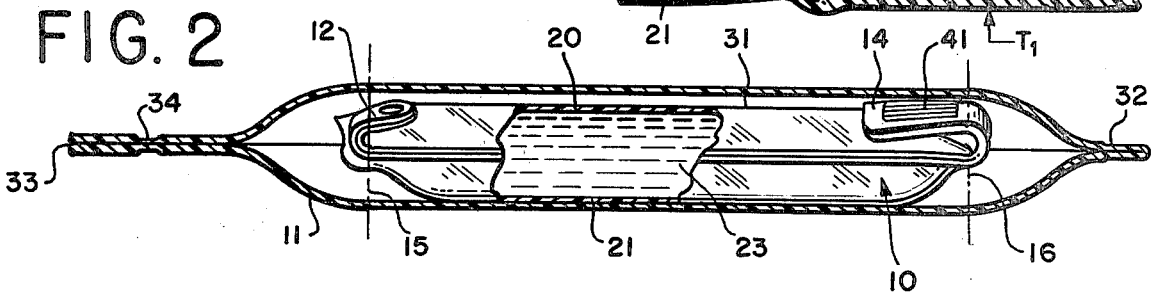
FIG. 2 is a cross-sectional view of the container and overpouch taken along line 2—2 of FIG. 1.
Figure 3:
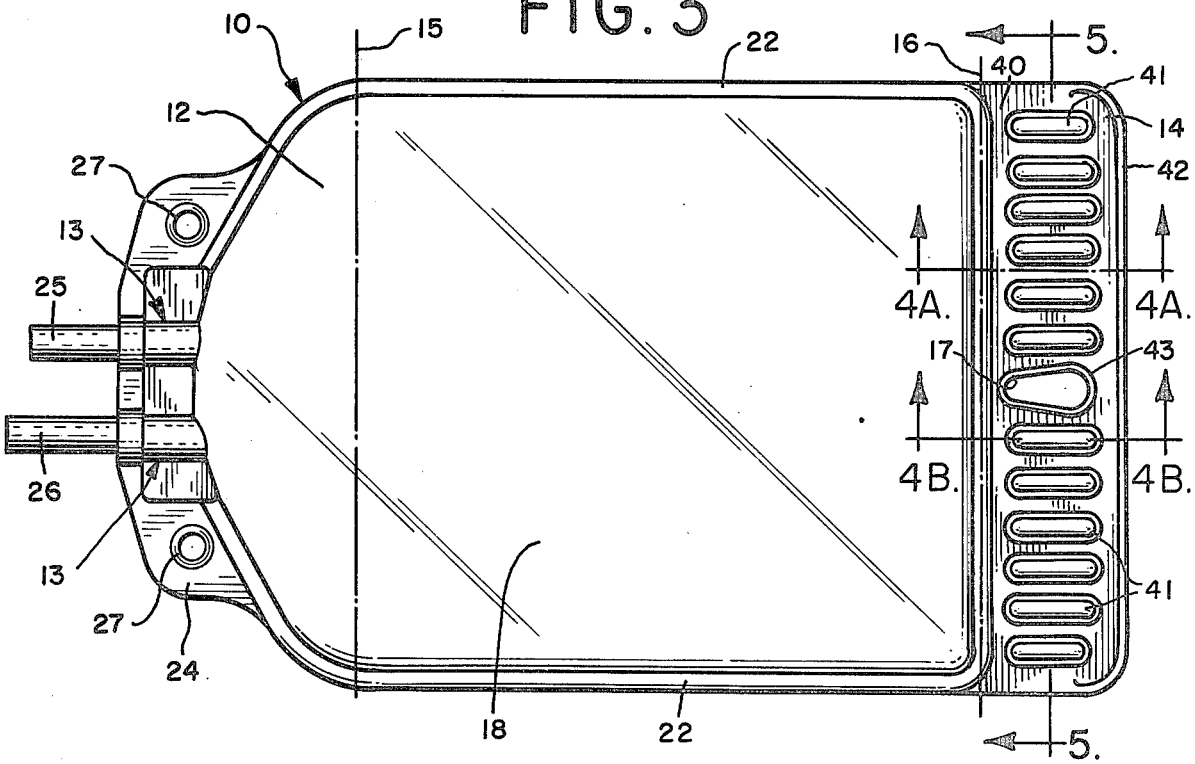
FIG. 3 is a top plan view of the container in an unfolded condition.
Figure 5:
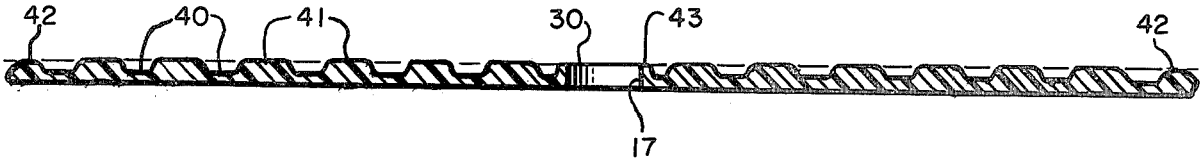
FIG. 5 is a cross-sectional view of the hang flap section of the container taken along line 5—5 of FIG. 3.

Referring to the Figures, and particularly to FIGS. 1 and 2, a single-dose liquid container 10 constructed in accordance with the invention for containing parental and urological solutions and the like is snown packaged for storage within an overpouch 11 of generally rectangular dimensions. The liquid container is seen in FIG. 3 to be generally rectangular in form, having a central generally rectangular body section 18, a port section 12 at one end of the body section including one or more ports 13 for the ingress and egress of the fluid, and a flap section 14 at the opposite end of the body section including an aperture 17 for suspension from an appropriate support member.

As most clearly shown in FIG. 2, when contained within overpouch 11 the port section 12 and the hang flap section 14 of container 10 are folded over against the top surface of the central body section 18 of the container along crease lines 15 and 16 (FIG. 3), respectively, to minimize the volume required by the combination during storage.

Container 10 is formed from two sheets 20 and 21 of a non-pyrogenic flexible plastic material such as polyvinylchloride joined by a seal 22 at their margins to form a liquid chamber 22. The port section 12 includes a tab portion 24 within which tubing segments 25 and 26 are bonded in a manner well known to the art so as to extend through the peripheral seal 22 to establish fluid communication with chamber 22. One or more apertures 27 may be optionally provided in the tab portion to index the container during the manufacturing process. Although two ports are shown in the illustrated embodiment, it will be understood that a lesser or greater number of such ports may be provided as required by the particular application. Furthermore, it will be understood that the tubing segments forming such ports may be of a length appropriate for the particular application and will ordinarily include an appropriate end seal.

Figure 4A:
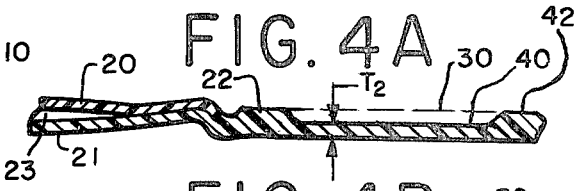
FIG. 4A is a cross-sectional view of the hang flap section of the container taken along line 4A—4A of FIG. 3.
Figure 4B:
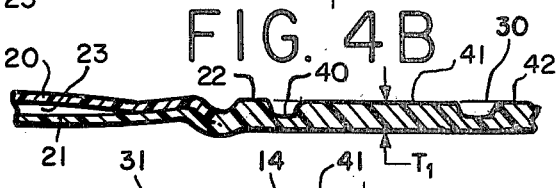
FIG. 4B is a cross-sectional view of the hang flap section of the container taken along line 4B—4B of FIG. 3.

The hang flap section 14 provided at the other end of body section 18 is formed from appropriately dimensioned sections of sheets 20 and 21 which extend beyond the peripheral seal 22 of the body section. In the illustrated embodiment these sections extend from crease line 16 and are overlapping and generally rectangular in form. When positioned within the overpouch 11, the hang flap section 14 is folded over along crease line 16 such that the top surface (as viewed unfolded in FIGS. 3 and 4) 30 of the hang flap section is brought into contact with the top surface 31 of the body section.

The overpouch 11 is preferably formed from a flexible plastic material such as polyethylene. The overpouch is formed as a sack having a sealed bottom end 32 and an open top end 33. Once the container has been inserted into the overpouch, the open end 33 is sealed along a seal line 34 to maintain the container in a sterile environment.

Figure 6:
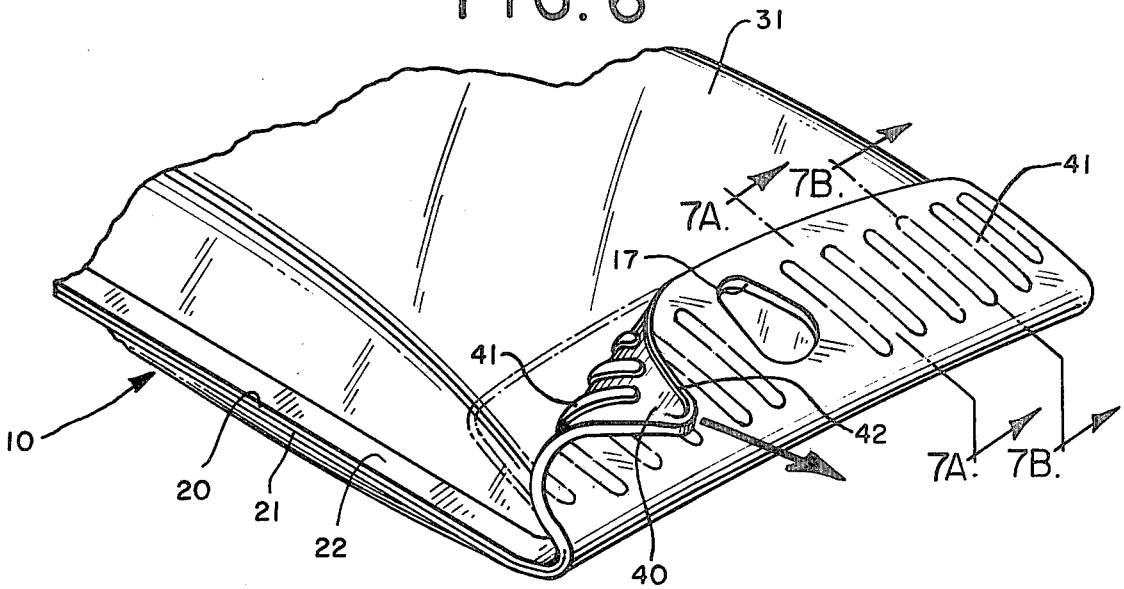
FIG. 6 is an enlarged perspective view of the hang flap section and underlying surface of the central body section of the container showing the hang flap section partially peeled away from a folded storage condition.
Figure 7A:
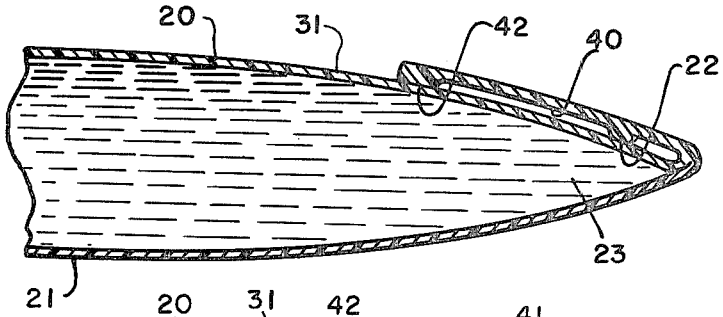
FIG. 7A is a cross-sectional view of the folded hang flap section taken along line 7A—7A of FIG. 6.
Figure 7B:
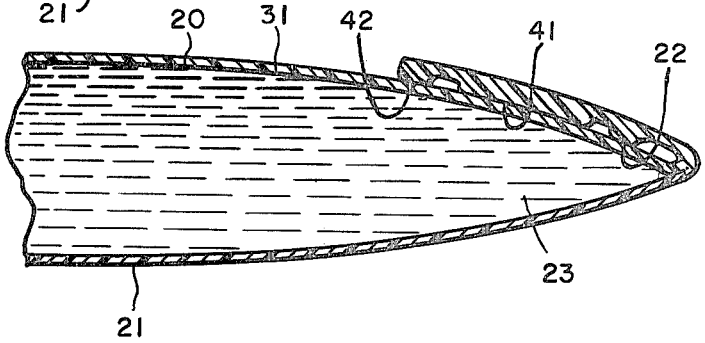
FIG. 7B is a cross-sectional view of the folded hang flap section taken along line 7B—7B of FIG. 6.

In accordance with the invention, adhesion between the surface 30 of hang flap section 14 and the underlying surface 31 of the central body section 18 is avoided during the autoclaving process by bonding the flap-forming extensions of sheets 20 and 21 together so as to form within the hang flap section a field portion 40 depressed from surface 30, and a plurality of raised spacer portions 41 which extend to surface 30, in effect establishing that surface when the hang flap is folded over surface 31. As a result, only the top surfaces of spacer portions 41 actually come into contact with surface 31, substantially reducing the tendency of the hang flap section to adhere to surface 31 when the hang flap section is peeled away as shown in FIG. 6. As shown in FIG. 7A, the spacing between the spacer portions 41 is sufficiently small that the depressed field portion 40 does not make surface contact with surface 31. As shown in FIG. 7B, only where the raised spacer portions exist is contact made with surface 31. Thus, when the hang flap section is folded over and pressed against surface 31 only a minimal contact area exists between the surfaces, minimizing the tendency for adherence between the hang flap section and surface 31 during autoclaving.

In addition to spacer portions 41, a transverse rib portion 42 may be provided across the end of hang flap section 14 for reasons of aesthetics and improved handling convenience. An additional rib portion 43 (FIG. 3) may also be provided around the periphery of aperture 17 to prevent the hang flap section from tearing under a heavy pull force while suspended from the aperture. An additional benefit provided by the spacer and rib portions is that they reduce the heat required to bond together the flap sections of sheets 20 and 21 in forming the hang flap section of the container.

In further accord with the invention, spacer portions 41 are preferably formed as elongated raised ribs in a direction generally perpendicular to crease line 16. As a result, the adhesive force presented to the user in peeling back the hang flap section upon opening overpouch 11 is minimized.

In one successful embodiment of the invention, a 250 milliliter container for intravenous solutions having an overall length of approximately 7.75 inches and a width of approximately 3.875 inches was formed from two sheets of polyvinylchloride material approximately 0.015 inch thick. A hang flap section having a length of approximately 0.75 inches was formed along one side of the container. Twelve raised rib-shaped spacer members each approximately 0.56 inches long and 0.125 inch wide and perpendicular to the hang flap crease line were disposed six on each side of a central slot-shaped aperture approximately one inch wide with a spacing of approximately 0.06 inch. The spacer portions were formed with a thickness $T_1$ (FIG. 4B) of approximately 0.035 inch within a field portion having a thickness $T_2$ (FIG. 4A) of approximately 0.018 inch.

It will be appreciated that raised spacer portions of various sizes, shapes and arrangements can be provided in the depressed field portion of the hang flap section depending on the size and capacity of the liquid container. For example, a matrix of raised rounded stud-shaped projections could be provided within the field. Furthermore, while the liquid container has been illustrated as formed of polyvinylchloride material, other heat-sealable materials having similar characteristics can be utilized instead.

The liquid container construction of the invention allows for compact storage within conventional overpouch enclosures. The tendency of the hang flap section of the container to adhere to the central body section of the container as a result of autoclaving is minimized by the novel depressed field and raised spacer construction of the hang flap section whereby the contact area between the surfaces of the hang flap and the container is minimized.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. A liquid container for storage in a folded condition between the sidepanels of an overpouch, comprising:

a central body section comprising first and second sheets of flexible non-pyrogenic plastic material sealed along a peripheral seal line to form therebetween a liquid chamber of predetermined volume;

a port section at one end of said body section including at least one liquid port extending through said seal line for establishing liquid communication with said chamber;

a hang flap section at the other end of said body section comprising substantially co-extensive portions of said sheets extending beyond the periphery of said chamber, said portions being sealed together and including an aperture therethrough;

said hang flap section being joined to said central body section along a crease line and being folded over along said crease line and compressed between the sidepanels of the overpouch for storage within the overpouch such that the top surface of said hang flap section is brought into contact with the top surface of said body section; and said portion of said sheets forming said hang flap section being sealed so as to form on the top surface of said hang flap section a depressed field portion and a plurality of raised spacer portions disposed within said field portion to reduce the contact area between the top surfaces, and thus the tendency for adhesion between the top surfaces during subsequent autoclaving of the container within the overpouch.

2. A liquid container as defined in claim 1 wherein said spacer portions comprise a plurality of elongated raised rib-shaped elements aligned generally perpendicular to said crease line and sufficiently closely spaced to prevent contact between the surface of said field portion and the top surface of said central body section.

3. A liquid container as defined in claim 1 wherein said sheets are formed of a polyvinylchloride material.

4. A liquid container as defined in claim 3 wherein said sheets are approximately 0.015 inch thick, said field portion has a thickness of approximately 0.018 inch, and said spacer portions have a thickness of approximately 0.035 inch and a spacing of approximately 0.06 inch.

5. In a liquid container for storage in a folded condition between the sidepanels of an overpouch, and of a type including a central body section comprising first and second sheets of flexible non-pyrogenic plastic material sealed along a peripheral seal line to form therebetween a liquid chamber of predetermined volume;

a port section at one end of said body section including at least one liquid port extending through said seal line for establishing liquid communication with said chamber;

a hang flap section at the other end of said body section comprising substantially co-extensive portions of said sheets extending beyond the periphery of said chamber, said portions being sealed together and including an aperture therethrough, and said hang flap section being joined to said central body section along a crease line and compressed between the sidepanels of the overpouch for storage within the overpouch such that the top surface of the hang flap section is brought into contact with the top surface of the body section;

the improvement comprising:

said portions of said sheets forming said hang flap section being sealed so as to form on the top surface of said hang flap section a depressed field portion and a plurality of raised spacer portions disposed within said field portion to reduce the contact area between the top surfaces, and thus the tendency for adhesion between the top surfaces during subsequent autoclaving of the container within the overpouch.

6. A liquid container as defined in claim 5 wherein said spacer portions comprise a plurality of elongated raised rib-shaped elements aligned generally perpendicular to said crease line and sufficiently closely spaced to prevent contact between the surface of said field portion and the top surface of said central body section.

7. A liquid container as defined in claim 5 wherein said sheets are formed of a polyvinylchloride material.

8. A liquid container as defined in claim 7 wherein said sheets are approximately 0.015 inch thick, said field portion has a thickness of approximately 0.018 inch, and said spacer portions have a thickness of approximately 0.035 inch and a spacing of approximately 0.06 inch.

9. A liquid storage container assembly comprising, in combination:

an overpouch including a pair of generally co-extensive sidepanels joined together along their periphery to form a storage compartment therebetween;

a central container body section comprising first and second sheets of flexible non-pyrogenic plastic material sealed along a peripheral seal line to form therebetween a liquid chamber of predetermined volume;

a port section at one end of said body section including at least one liquid port extending through said seal line for establishing liquid communication with said chamber;

a hang flap section at the other end of said body section comprising substantially co-extensive portions of said sheets extending beyond the periphery of said chamber, said portions being sealed together and including an aperture therethrough;

said hang flap section being joined to said central body section along a crease line and being folded over along said crease line and compressed between the sidepanels of the overpouch for storage within said storage compartment of said overpouch such that the top surface of said hang flap section is brought into contact with the top surface of said body section; and said portions of said sheets forming said hang flap section being sealed so as to form on the top surface of said hang flap section a depressed field portion and a plurality of raised spacer portions disposed within said field portion the contact area between the top surfaces, and thus the tendency for adhesion between the top surfaces during a subsequent autoclaving of the container within the overpouch.

10. A liquid container as defined in claim 9 wherein said spacer portions comprise a plurality of elongated raised rib-shaped elements aligned generally perpendicular to said crease line and sufficiently closely spaced to prevent contact between the surface of said field portion and the top surface of said central container body section.

11. A liquid container as defined in claim 9 wherein said sheets are formed of a polyvinylchloride material.

12. A liquid container as defined in claim 11 wherein said sheets are approximately 0.015 inch thick, said field portion has a thickness of approximately 0.018 inch, and said spacer portions have a thickness of approximately 0.035 inch and a spacing of approximately 0.06 inch.

* * * * *